US005728269A

United States Patent [19]

Kohno et al.

[11] Patent Number: 5,728,269

[45] Date of Patent: Mar. 17, 1998

[54] BOARD PRODUCED FROM MALVACEOUS BAST PLANT AND PROCESS FOR PRODUCING THE SAME

[75] Inventors: Tsuyoshi Kohno, c/o Kohno Shinsozai Kaimatsus Co., Ltd., 333-189, Midoro-cho, Matsuyama Ehime, Japan, 791-02; Hiroharu Yamaguchi, Fuwa-gun, Japan

[73] Assignees: Atsushi Onishi, Tokyo; Tsuyoshi Kohno, Ehime, both of Japan

[21] Appl. No.: 696,892

[22] PCT Filed: Dec. 22, 1995

[86] PCT No.: PCT/JP95/02635

§ 371 Date: Oct. 18, 1996

§ 102(e) Date: Oct. 18, 1996

[87] PCT Pub. No.: WO96/19328

PCT Pub. Date: Jun. 27, 1996

[30] Foreign Application Priority Data

Dec. 22, 1994 [JP] Japan ..... 6-336092
Mar. 22, 1995 [JP] Japan ..... 7-090332

[51] Int. Cl.[6] ..... D01C 1/02; D21H 11/12

[52] U.S. Cl. ..... 162/148; 162/13; 162/21; 162/98; 162/225; 428/326; 264/109; 264/124

[58] Field of Search ..... 162/98, 99, 91, 162/21, 13, 10, 11, 12, 141, 148, 149, 206, 224, 225; 428/326; 264/109, 124

[56] References Cited

U.S. PATENT DOCUMENTS

| | | | |
|---|---|---|---|
| 5,017,319 | 5/1991 | Shen | 264/124 |
| 5,492,756 | 2/1996 | Seale et al. | 428/326 |

FOREIGN PATENT DOCUMENTS

| | | |
|---|---|---|
| 60-206604 | 10/1985 | Japan . |
| 4-219203 | 8/1992 | Japan . |
| 4-336202 | 11/1992 | Japan . |
| 6-47713 | 2/1994 | Japan . |
| 6-126715 | 5/1994 | Japan . |
| 6-253390 | 9/1994 | Japan . |

*Primary Examiner*—Donald E. Czaja
*Assistant Examiner*—Steven B. Leavitt
*Attorney, Agent, or Firm*—Pearne, Gordon, McCoy & Granger LLP

[57] ABSTRACT

A board composed of a lignocellulosic material and the modification thereof as the substantial components and having good mechanical strength, even when the board does not contain any components derived from an additive, by utilizing the autoadhesion of a specified lignocellulosic substance. This board is produced by molding under heat and pressure a lignocellulosic substance containing at least 30 weight % of a *malvaceae bast* plant, being substantially free from any component derived from an adhesive, and has a strength value of more than 100 as defined by the following formula (I): $0.48 \times Y/X^2$, wherein Y is a bending strength ($kgf/cm^2$) and X is a density ($g/cm^3$). A particulaly preferable example of the plant is the kenaf.

16 Claims, 1 Drawing Sheet

BOARD PRODUCED FROM MALVACEOUS BAST PLANT AND PROCESS FOR PRODUCING THE SAME

TECHNICAL FIELD

The present invention relates to a board such as a particle board and a fiber board using a *Malvaceous bast* plant as the raw material and a method for producing thereof.

BACKGROUND TECHNOLOGY

It had been well known for a long time a board could be produced by merely heating and pressurizing small fragments of a lignocellulosic material without using adhesive agent. This method depends mainly on the intertwinding of the lignocellulosic fibers or the hydrogen bond between the fibers, and since the chemical adhesion of the lignocellulosic material is small; thus the strength performance of the product is highly inferior.

Regarding the method for producing the board using the chemical adhesion effect of the lignocellulosic material, two methods are known, one is a method of utilizing a component of a natural plant and the other is a method of converting a part of the lignocellulosic material into an adhesive material by a high-temperature and high-pressure steam treatment.

As to the former method, Japanese Patent Application 59-14338, the production of a board, in which pulverized plant leaves are used as an alternative for an adhesive. Moreover, Japanese Patent Application, First Publication No.S60-30309 of 1985 discloses a method for the production of a board, in which a lignocellulosic substance containing a large amount of a free saccharide is used as the raw material. As such a lignocellulosic material disclosed are the sugar cane bagasse, African millet stalk, the corn stalk, the sunflower stalk, and the flax stalk. Furthermore, Japanese Patent Application, Second Publication No.H3-31565 of 1991 discloses a method for the preparation of a board in which a saccharide or a starch is added as an adhesive, although they are not necessarily a lignocellulosic substance.

The latter method by treating in high-temperature and high-pressure steam is disclosed in Japanese Patent Application, First Publication No.S49-74773 of 1971 and No.S60-206604 of 1985 and U.S. Pat. No. 5,017,319.

The method of Japanese Patent Application, First Publication No.S49-74773 of 1971 is characterized in that a wood fiber is treated in the steam at 150° to 180° C. and that the molding temperature is 250° to 280° C. The method of Japanese Patent Application, First Publication No.S60-206604 of 1985 is characterized in that a lignocellulosic material contained in a pressure vessel is heated at a temperature of not lower than 190° C. within a period of 10 minutes by supplying the high-temperature and high-pressure steam to the vessel rapidly and that the molding temperature of the board is made preferably to be 200° to 220° C.

In addition, U.S. Pat. No. 5,017,319 79 is a U.S. patent application corresponding to Japanese Patent Application, First Publication No. 206604 of 1985 and is characterized in that a lignocellulosic material is treated with the high-temperature and high-pressure steam for a sufficient period to decompose the hemicellulose contained in the lignocellulose and to convert the hemicellulose to a water-soluble resin and that the relationship between the preferred steam temperature T (°C.) and the treating period t (seconds) is defined by the following equation:

$$T\,(°C.)=306.4-35.7\,\mathrm{Log}_{10}\,t(\mathrm{second})\pm 15.$$

However, any of the boards prepared by those methods are inferior in the mechanical strength to those prepared by using usual adhesives and are below the level of satisfying industrial requirements comparing the industrial products such as particle boards and fiber boards.

Among the above methods, methods disclosed in Japanese Patent Application, first Publication No.206604 of 1985 and U.S. Pat. No. 5,017,319 require a steaming condition with special equipment such as a steam generator for a pressure of at least 20 kgf/cm$^2$ and a pressure vessel tolerable to that condition, so that the process is impractical.

The object of the present invention is to provide a mechanically strong board which contains a specified lignocellulosic material and a modified material thereof as the substantial components, without containing a component originated from the adhesive material, by effectively utilizing the self-adhering ability of the specified lignocellulosic material and also to provide a board having an excellent mechanical strength, irrespective of containing a very small amount of the component originated from the adhesive.

Another object of the present invention is to provide a method for the preparation of such a wood board effectively and at low cost.

SUMMARY OF THE INVENTION

The present invention attains the above object by using a *Malvaceous bast* plant which had been used originally as a fiber material for ropes and clothings.

By using a *Malvaceous bast* plant, a board having more excellent strength performance than those using other lignocellulosic substances is obatined, by merely applying a conventional method of production. In addition, it has been found that a board with an excellent strength performance can be produced by properly treating a *Malvaceous bast* plant with high temperature and high pressure steam. The optimum condition for a high-temperature and high-pressure steam treatment is far milder and easier than the optimum condition for the steam treatment of conventional lignocellulosic material other than the *Malvaceous bast* plant.

The product according to the present invention is a board prepared by molding a lignocellulosic substance under heating and pressurizing. It is characterized in that at least 30 weight % of the lignocellulosic substance is the *Malvaceous bast* plant, without substantially containing the material originated from an adhesive and the value derived from the following equation I is not less than 100:

$$\text{value}=0.48\times Y/X^2 \qquad \text{(Equation I)}$$

where, Y is the bending strength (kgf/cm$^2$) and X is the density of the board (g/cm$^3$). In the board of the present invention, the *malvaceous bast* plant is naturally contained as being partly denatured by heating and pressurizing in its manufacturing process. The board of the present invention may be not only plane but also can be molded three-dimensionally and includes those of both two- and three-dimentional shape.

According to the present invention, as seen in the Examples shown below, the board has the mechanical strength of more than 100 as the value of the above Equation I, particularly the strength of more than 130 can be easily produced, even though no adhesive is substantially used.

The mechanical strength of the product of the present invention is expressed by the value of the equation I and the bending strength Y is measured by a method in accordance with JIS A 5908 5–6. The specific gravity of the product of the present invention is usually 0.2 to 1.4 g/cm$^3$, preferably 0.3 to 1.1 g/cm$^3$, though different according to the desired board.

The *malvaceous bast* plant in the present invention means a plant which is included in a group of the hemp in a wide sense, and in which the bast is used for a long fiber material and which belongs taxonomically to Malvaceous. Practically, the plant includes a kenaf and an indian mallow. In the present invention, the kenaf is preferable. The Kenaf is an annual plant of *malvaceous hibiscus* genus and an improved breed may be used. In the present invention, the stalk or particularly the woody stalk of a *Malvaceous bast* plant is preferably used. Conventionally, in the production of a long fiber material, only the bast in the stalk part has been used and the woody part has been discarded. It should be noted that the woody stalk is effectively used industrially. Although the shape of the *Malvaceous bast* plant is not limited in the present invention, it can be used in the shapes of cut stalk, chip, flake, fiber, or powder.

The product of the present invention may be a combination of a *Malvaceous bast* plant and another lignocellulosic material. The lignocellulose material used in combination is a substance containing mainly cellulose, hemicellulose and lignin as the main components and exemplified by woods, barks and pulps but naturally is not limited to them. The form of use may be tip, flake, fiber or powder in the same manner as in the *Malvaceous bast* plant.

The product of the present invention can be easily prepared by molding such a *Malvaceous bast* plant by heating and pressurizing and it is preferred to use a *Malvaceous bast* plant previously treated by high temperature and high pressure steam.

The heat pressure molding in the manufacturing method of the present invention is carried out at a temperature of 180° to 250° C. It is because the molding at temperature lower than 180° C. not only requires a long-term heating/pressurizing but also gives an insufficient curing reaction unfavorably, whereas molding at the temperature exceeding 250° C. deteriorates the *Malvaceous bast* plant and the mechanical strength of the board. It is preferrable to carry out the molding at an temperature range of 200° to 230° C.

When molding, the moisture content of the molding material is preferably 20% or less, and more preferably 10% or less.

The molding time is specified by the molding temperature and the size of the board. The molding pressure is varied in accordance with mainly the specific gravity of the desired board.

In the present invention, it is preferred at least the part of the *malvaceous bast* plant, for example, 10 weight %, or more preferably 50 weight % or more, is treated with high temperature and high pressure before use. The treating temperature is preferably 105° to 210° C., more preferably 120° to 190° C. Naturally, the time should be long when the treating temperature is low, while the time should be short when the temperature is high. However, when the treating temperature is lower than 105° C., the self-adhesive effect of the *Malvaceous bast* plant is insufficient, and no desired product is obtained. While, when the treating temperature is higher than 210° C., the fiber structure of the *Malvaceous bast* plant is deteriorated disadvantageously.

The relationship between the temperature T (°C.) and the time t (minute) in the high temperature and high pressure steam treatment is shown by the following equation.

$$T=194-46\log_{10} t\pm 40 \quad \text{(Equation II)}$$

The particularly preferable relationship is expressed by the following equation.

$$T=194-46\log_{10} t\pm 20 \quad \text{(Equation III)}$$

The methods for steam treating at high temperature and high pressure include, (A) a method in which the *malvaceous bast* plant and water are put into a pressure vessel and then the mixture is heated to a predetermined temperature, (B) a method in which the pressure vessel containing the *malvaceous bast* plant is connected to a high temperature and high pressure steam generator and the steam is supplied from said high temperature and high pressure steam generator to said pressure vessel. However, the methods are not limited to those.

The treating temperature in the high temperature and high pressure steaming in the method of (B) does not mean the temperature of steam supplied from the generator, but means the temperature in the pressure vessel after steam has been supplied.

The amount of water in the high temperature and high pressure steam treating is dependent upon the temperature and the pressure of steam and the treating method and cannot be defined unconditionally. However, the amount of water is preferably in the range of 50 to 500 weight % against the *malvaceous bast* plant, and more preferably 100 to 300 weight %.

Although no adhesive is required to be used in the production of the present invention, an adhesive or a formaldehyde type curing agent can be added, if the amount does not exceed 5 weight % against the lignocellulosic material. However, it is not preferable to use a large quantity of those adhesive or curing agent, because it is not only uneconomical but also give contamination in the working environment. Particularly, the addition of the formaldehyde type curing agent should be restricted less than 3 weight %.

In case when the adhesive is added, the adhesive is added less than 5 weight % against the lignocellulosic material containing more than 20 weight % of the *malvaceous bast* plant. The mixture is then molded by heating and pressurizing at a temperature range of 180° to 250° C., preferably at a range of 200° to 230° C. to produce a board having the above-mentioned mechanical strength value of 100 or more, preferably 130 or more, when calculated by the above Equation I. In this case, it is preferred to use a lignocellulosic substance containing 20 weight % or more of a *Malvaceous bast* plant treated by the high temperature and high pressure steam under the condition expressed by the above Equation II.

As an adhesive, it is preferable to use a synthetic resin usually used in the fabrication of resin boards, such as phenol resin, urea resin and melamine resin board, but naturally the present invention is not limited to those resins. As the formaldehyde type curing agents, hexamethylenetetramine, paraformaldehyde, polypxymethylene, etc. can be used preferably.

Furthermore, in the present invention, a small amount of an additive such as a mold-releasing agent and a water-repellent agent can be added to the lignocellulosic substance.

In the present invention, when the formaldehyde type curing agent, an adhesive, a mold-releasing agent or a water-repellent agent is used, it is necessary to add them to the lignocellulosic material before molding under a heat and a pressure. Even when the lignocellulose material is treated with high temperature and high pressure, it is necessary to add them after those agent are treated before molding operation.

The reason why the board prepared by the method according to the present invention exerts an excellent performance is not necessarily clear but the followings are assumed.

The reaction mechanism in which hemicellulose, one of the main components of a lignocellulosic substance, is decomposed to an aldehyde such as furfural through a monosaccharide such as pentose under a condition of high temperature and high pressure has been well known generally. Japanese Patent Application, First Publication No.S60-206604 of 1985 describes that the free saccharides, furfural and other decomposition products mainly formed by the decomposition of hemicellulose are the essential parts exerting the adhesive effect. Furthermore, according to our experiment, when four lignocellulosic material of hinoki (a needle leaf tree), Japanese oak (a broadleaf tree), lauan (a South Asain tree) and rice hulls were treated by the high temperature and high pressure steam for 3 minutes, a board could be molded at a treating temperature of 180° C. or higher in all cases and the bending strength of the board reached maximum at the molding temperature of 210° to 220° C. At that time, when the odor of the sample was smelled, immediately after treated by high temperature high pressure steam, furfural odor was detected from one treated at a temperature of 180° C. or higher at which it can be molded. Furfural odor was smelled most strongly at a temperature of 210° to 220° C. at which the bending strength of the board reached maximum. These results support the assumption of the description in Japan Patent Application, First Publication No. 206604 of 1985.

While, by an experiment carried out by using kenaf, a same result as for the above lignocellulosic substance was obtained that furfural odor was smelled at a temperature of 180° C. or higher and most strongly smelled at a temperature of 210° to 220° C. However, the bending strength of the board reached maximum at a treating temperature of 170° to 180° C. and a treating temperature higher than those caused lowering of the bending strength consequently.

From the above observation, the self-adhesive activity of kenaf can be thought to include a factor different from the principle of generation of the adhesion effect in a usual lignocellulosic substance.

Regarding the *malvaceous bast* plant, a viscous liquid contained in the root of *abelnoshusmanihot* has been used as the most important size in the field of the manufacture of Japanese paper. From this fact, it can be thought that the *malvaceous bast* plant contains a special adhesive component different from other lignocellulosic substances.

Although Japanese Patent Application, First Publication No. 30309 of 1985 discloses flax included in hemp in a broad sense, the hemp is a popular name for the plant utlized as a long fiber material and each of the hemp differs taxonomically and in the components. For reference, the types and the compositions of hemp and the family and the compositions or bagasse which is defined as a material particularly preferred in Japanese Patent Application, First Publication No. 30309 of 1985 are shown in Table 1.

In Table 1, high contents of both the amorphous cellulose and lignin in kenaf, particularly its woody part of kenaf, may be one of the factors by which the board of the present invention exerts an excellent performance.

TABLE 1

Families and compositions of hemp and bagasse

| Type | Family | α-cellulose (%) | Amorphous cellulose (%) | Lignin (%) |
|---|---|---|---|---|
| Kenaf all stalk | Malvaceae | 50.7 | 26.8 | 15.9 |
| Kenaf bast | | 57.5 | 20.7 | 8.8 |
| Kenaf woody part | | 46.3 | 30.8 | 20.9 |

TABLE 1-continued

Families and compositions of hemp and bagasse

| Type | Family | α-cellulose (%) | Amorphous cellulose (%) | Lignin (%) |
|---|---|---|---|---|
| Thai kenaf stalk | | 37.8 | 36.5 | 16.4 |
| Indian mallow | | ? | ? | 15.4 |
| Jute | Tiliaceae | 61.0 | 10.5 | 14.5 |
| Sisal hemp | Amaryllidaceae | 53~64 | 12~13 | 6.5 |
| Manila hemp | Musaceae | 53~64 | 2~13 | 11.6 |
| Hemp | Moraceae | ? | ? | 12.8 |
| Flax | Linaceae | 64.1 | 16.0 | 14.5 |
| Bagasse | Gramineae | 41.5 | 13.0 | 20.0 |

BRIEF DESCRIPTION OF THE DRAWING

In FIG. 1, the mark 0 gives the point showing the temperature T (°C.) and the time t (minute) where the value of the Equation I reached maximum in the high temperature and high pressure steaming in Example 10 (kenaf) and shows the value in line with the curve of the Equation II, that is; $T=194-46 \log_{10} t$.

Figure 1:
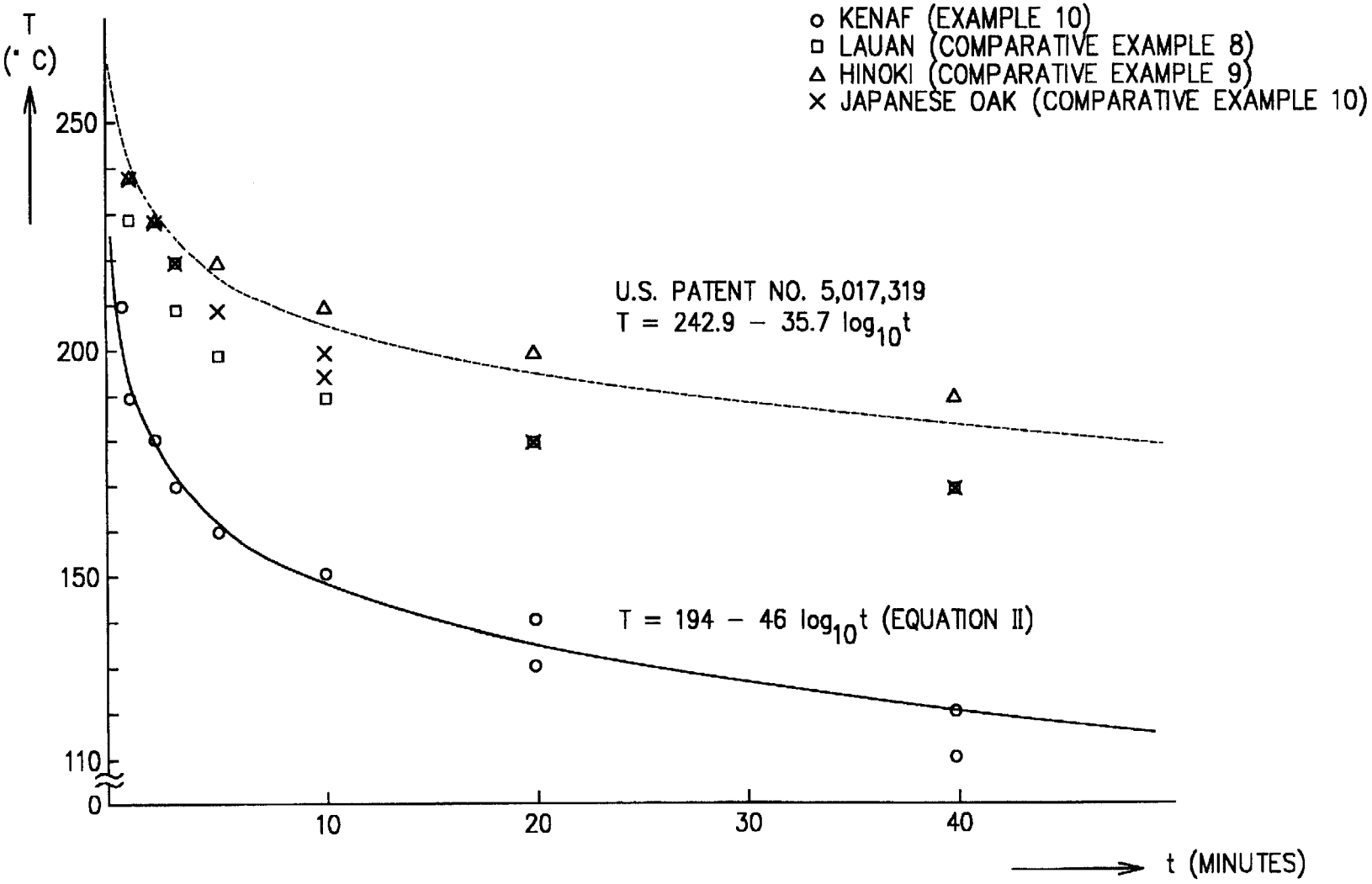
FIG. 1 is a diagram showing the optimum steaming condition of a lignocellulosic material.

The marks □, Δ, and x give the points showing temperatures T (°C.) and times t (minute) where the values of the equation I reached maximum in the high temperature and high pressure steaming of corresponding lignocellulosic raw materials (lauan, hinoki and Japanese oak ) in Comparative Examples 8 to 10. They are values in line with the curve of the equation giving the relationship between the steaming temperature T (°C.) and the time t (minute) defined to be optimum in U.S. Pat. No. 5,017,319.

MOST PREFERABLE EMBODIMENT

Now, the most preferable embodiment of the present invention will be described in more detail, but the present invention is not limited by the above example.

Molding the boards in the embodiments and comparative examples were carried out in the use of a hydraulic press equipped with an electric heater, which is capable of molding a 50 cm square plate. A 100 g of raw materials after moisture conditioning was scattered in the mat-forming box of 220 mm square and the molding was carried out by heating the mold to a predetermined temperature at a prescribed pressure of 50 kgf/cm$^2$ with a spacer of 2.1 mm in size for a predetermined time.

The temperature for the heating in the embodiments and comparative examples means that of the hot plate during molding.

The bending strengths of the molded boards in the embodiment and comparative examples were taken as the average values from the measurement of three specimens prepared by cutting each molded board to a size of 50×200 mm in accordance with JIS A 5908, 5–6.

The kenaf or other lignocellulosic substance is finally molded by heating and pressurizing in a form of chip, flake or fiber. In the embodiments and in the comparative examples, a Pallman knife ring flaker was used and flakes prepared at a blade thrust of 0.6 mm were used. Accordingly, flakes in the embodiments and the comparative examples mean small pieces prepared by the above method.

The treatment under the high temperature and high pressure steam for the embodiment and the comparative examples was carried out with a combined vessels of a 3 liter high pressure vessel (A) equipped with a heater and a 1 liter high pressure vessel (B) equipped with a heater connected each other by an connecting tube, except embodiments 11 and the comparative examples 11 and 12.

The treatment starts by supplying 150 g of a lignocellulosic raw material such as kenaf or others and 50 g of water into the high pressure vessel (A) and the mixture is preheated until the inner temperature reaches 100° C. (for about 10 to 15 minutes). In the high pressure vessel (B), heated water at 280° C. is prepared and the valve of the connecting tube is opened to feed the high temperature and high pressure steam into the high pressure vessel (A). As the inner temperature of the high pressure vessel (A) rises rapidly by said steam, it is adjusted to a desired temperature while controlling the amount of said steam (within around 1 minute) and the inner temperature of the vessel (A) is held for a given period. Finally, water is sprinkled on the vessel (A) to cool it until the temperature falls to 100° C. or less (takes 5 to 10 minutes) and the sample is then taken out.

The treating temperatures in the embodiments and the comparative examples are the inner temperatures of the vessel (A), and the holding time is the period when the temperature is held constant.

The moisture content of the kenaf and other lignocellulosic material in the embodiments and the comparative examples are adjusted within the range of 5 to 10%. The moisture adjustment is conducted by heating these material at 105° C. when the adhesive is not used, and by heating at 80° C. and by keeping for 72 hours in the atmosphere at 20° C. and 65% RH.

EMBODIMENT 1

The woody portion after removing the bast from the stalk of kenaf (rod-shaped in 0.5 to 2.0 mm dia.) was air-dried and flaked (referred to as "the kenaf woody flake" hereinafter). After the kenaf woody flake was moisture conditioned and then molded by heating and pressurizing at 210° C. for 3 minutes to prepare the board containing merely the woody kenaf and its denatured components. The density of the board was 0.92 g/cm$^3$, and the bending strength was 263 kgf/cm$^2$ and the value of the Equation I was 149.

COMPARATIVE EXAMPLE 1

The preparation of a board containing merely a lignocellulosic material and its denatured component was attempted in the same manner as in the embodiment 1 except that lauan flake was used as the raw material, but the solid board was not obtained.

COMPARATIVE EXAMPLE 2

A board containing merely a lignocellulosic material and its denatured components was prepared in the same manner as in the embodiment 1 except that the hinoki flake was used as the raw material. The density of the board was 0.820 g/cm$^3$, and the bending strength was 47 kgf/cm$^2$ and the value of the Equation I was 34.

COMPARATIVE EXAMPLE 3

A board containing merely a lignocellulosic material and its denatured component was prepared in the same manner as in the embodiment 1 except that bagasse flake was used as the raw material.

The density of the board was 0.87 g/cm$^3$, and the bending strength was 132 kgt/cm$^2$ and the value of the Equation I was 84.

EMBODIMENT 2

The woody portion after removal the bast from the kenaf stalk in rod-shape in the diameter of 0.5 to 2.0 mm was air-dried and treated with the high temperature and high pressure steam at the temperature of 180° C. for 3 minutes, and then flaked for preparing sample (a). After the sample (a) was moisture conditioned, it was molded by pressurizing and heating at 210° C. for 3 minuites to prepare a board containing merely kenaf and its denatured component.

The density of the board was 0.87 g/cm$^3$, the bending strength was 419 kgf/cm$^2$ and the value of the Equation I was 266.

EMBODIMENT 3

A board containing merely a lignocellulosic material and its denatured component was prepared in the same manner as in the embodiment 2 except that the treating temperature in the high temperature and high pressure steam was 130° C. and the treating period was 20 minutes.

The density of the board was 0.910 g/cm$^3$, the bending strength was 387 kgt/cm$^2$ and the value of the Equation I was 224.

EMBODIMENT 4

A board containing merely a lignocellulosic material and its denatured component was prepared in the same manner as in the embodiment 2 except that the treating temperature in the high temperature and high pressure steam was 220° C. and the treating period was 2 minutes.

The density of the board was 0.880 g/cm$^3$, the bending strength was 167 kgf/cm$^2$ and the value of the Equation I was 104.

EMBODIMENT 5

A board containing merely a lignocellulosic material and its denatured component was obtained in the same manner as in the embodiment 2, except that the kenaf stalk after air-dried and cut to about 30 cm length was used as the raw material. cm dia.)

The density of the board was 0.895 g/cm$^3$, the bending strength was 422 kgf/cm$^2$, and the value of the Equation I was 253.

COMPARATIVE EXAMPLE 4

A board containing merely a lignocellulosic material and its denatured component was prepared in the same manner as in the embodiment 2, except that the hinoki was used as the raw material.

The density of the board was 0.840 g/cm$^3$, the bending strength was 83 kgf/cm$^2$, and the value of the Equation I was 56.

COMPARATIVE EXAMPLE 5

A board containing merely the hinoki and its denatured product was prepared in the same manner as in the comparative example 4, except that the treating temperature in the high temperature and high pressure steam was 220° C. and the treating period was 2 minutes.

The density of the board was 0.910 g/cm$^3$, the bending strength was 111 kgf/cm$^2$, and the value of the Equation I was 64.

COMPARATIVE EXAMPLE 6

A board containing merely a lignocellulose and its denatured product was prepared in the same manner as in the comparative example 5 except that the Japanese oak was used as the raw material.

The density of the board was 0.939 g/cm$^3$, the bending strength was 126 kgf/cm$^2$, and the value of the Equation I was 70.

COMPARATIVE EXAMPLE 7

A board containing merely a lignocellulose and its denatured product was prepared in the same manner as in the comparative example 5, except that lauan was used as the raw material.

The density of the board was 0.880 g/cm$^3$, the bending strength was 50 kgf/cm$^2$, and the value of the Equation I was 31.

EMBODIMENT 6

A board containing merely the kenaf and its denatured product was prepared in the same manner as in the embodiment 2, except that the temperature in the molding was 170° C. and the molding period was 10 minutes.

The density of the board was 0.850 g/cm$^3$, the bending strength was 218 kgf/cm$^2$, and the value of the Equation I was 145.

EMBODIMENT 7

A board containing only the kenaf and its denatured product was prepared in the same manner as in the embodiment 2 except that the temperature in the molding was 250° C.

The density of the board was 0.905 g/cm$^3$, the bending strength was 252 kgf/cm$^2$, and the value of the Equation I was 148.

EMBODIMENT 8

A board containing more than 97% of the kenaf and the component originated from the kenaf was prepared in the same manner as in the embodiment 1, except that 10 weight % aqueous solution of hexamethylenetetramine was added by 2 weight % to the main raw material of the kenaf woody flake.

The density of the board was 0.870 g/cm$^3$, the bending strength was 280 kgf/cm$^2$, and the value of the Equation I was 178. The content of kenaf and the components originated from the kenaf in the board was calculated to be more than 98%.

EMBODIMENT 9

A board containing more than 97% of the kenaf and the components originated from the kenaf without containing component originated from the adhesive was prepared in the same manner as in the embodiment 1, except that 10 weight % aqueous solution of hexamethylenetetramine was added by 2 weight % to the main kenaf flakes.

The density of the board was 0.911 g/cm$^3$, the bending strength was 463 kgf/cm$^2$, and the value of the Equation I was 268. The content of the kenaf and the components originated from the kenaf in the board was calculated to be more than 98%.

The composition and properties of the boards obtained in the embodiments and the comparative examples are shown in Table 2. All of the boards prepared in the embodiments showed 130 or higher strength values of the Equation I, whereas those prepared in the comparative examples by use of the lignocellulosic material other than the kenaf showed 84 or lower strength values of the Equation I, which cannot be used in the practical application.

It was also recognized in the embodiments that the board of higher strength could be fabricated when the temperature of the steam treatment is 120° to 190° C. and the condition of the steam treatment satisfies the relationship of the Equation II. In addition, when the pressing temperature is in the range of 200° to 230° C., the high strength board was also obtained.

EMBODIMENT 10

In Table 3, the strength properties obtained by the Equation I are shown for the board prepared by use of the kenaf woody flakes by the same process in the embodiment 2, first treated in the high temperature and high pressure steam at the given temperatures for the given periods and then flaked, dried and molded by heating and pressurizing at 210° C. for 3 minutes.

TABLE 2

| Lignocellulosic substance*1) (Treating condition: °C. × min) | Additive*2) | Molding condition °C. × min | Product properties: Specific gravity g/cm$^3$ | Bending strength kgf/cm$^2$ | Value of Eq. I |
|---|---|---|---|---|---|
| Example | | | | | |
| 1 Kenaf | — | 210 × 3 | 0.92 | 263 | 149 |
| 2 Treated kenaf (180 × 3) | — | 210 × 3 | 0.87 | 419 | 266 |
| 3 Treated kenaf (130 × 20) | — | 210 × 3 | 0.910 | 387 | 224 |
| 4 Treated kenaf (220 × 2) | — | 210 × 3 | 0.880 | 167 | 104 |
| 5 Treated kenaf (180 × 3) | — | 210 × 3 | 0.895 | 422 | 253 |
| 6 Treated kenaf (180 × 3) | — | 170 × 10 | 0.850 | 218 | 145 |
| 7 Treated kenaf (180 × 3) | — | 250 × 3 | 0.905 | 252 | 148 |
| 8 Kenaf | HMTM 2% | 210 × 3 | 0.870 | 280 | 178 |
| 9 Treated kenaf (180 × 3) | HMTM 2% | 210 × 3 | 0.911 | 463 | 268 |
| Comparative Example | | | | | |
| 1 Lauan | — | 210 × 3 | Unmoldable | | |
| 2 Hinoki | — | 210 × 3 | 0.820 | 47 | 34 |
| 3 Bagasse | — | 210 × 3 | 0.870 | 132 | 84 |
| 4 Treated Hinoki (180 × 3) | — | 210 × 3 | 0.840 | 83 | 56 |
| 5 Treated Hinoki (220 × 2) | — | 210 × 3 | 0.910 | 111 | 64 |
| 6 Treated Jap. oak (220 × 2) | — | 210 × 3 | 0.930 | 126 | 70 |
| 7 Treated lauan (220 × 2) | — | 210 × 3 | 0.880 | 50 | 31 |

*1)The figures in the parenthesis show the treating conditions. For example, the description "Treated kenaf (180 × 3)" means kenaf steamed at high temperature under high pressure at 180° C. for 3 minutes.

*2)HMTM means hexamethylenetetramine and "%" shows the weight % based on the lignocellulosic substance.

COMPARATIVE EXAMPLES 8 TO 10

The temperatures and the periods of the high temperature and high pressure steam treatment and the values of the equation I for the boards prepared by the same process with the embodiment 10 except that the lauan, the hinoki and the Japanese oak were used as the raw materials are shown in Table 3.

TABLE 3

| Raw material | Temperature (°C.) | Period (minute) 0.5 | 1 | 2 | 3 | 5 | 10 | 20 | 40 | 90 |
|---|---|---|---|---|---|---|---|---|---|---|
| Example 10 | | | | | | | | | | |
| Kenaf | 210 | *256 | 135 | 72 | | | | | | |
| | 190 | 228 | *310 | 245 | 142 | | | | | |
| | 180 | | 258 | *337 | 248 | 176 | | | | |
| | 170 | | | 246 | *308 | 210 | 116 | | | |
| | 160 | | | | 216 | *278 | 189 | 131 | | |
| | 150 | | | | 198 | 220 | *280 | 236 | | |
| | 140 | | | | | 181 | 274 | *286 | 116 | |
| | 130 | | | | | | 202 | *316 | 248 | |
| | 120 | | | | | | | 254 | *321 | 186 |
| | 110 | | | | | | | 226 | *248 | 174 |
| | 100 | | | | | | | | 226 | *298 |
| Comparative Example 8 | | | | | | | | | | |
| Lauan | 230 | | *66 | 56 | 32 | 12 | | | | |
| | 220 | | 49 | 54 | *56 | 42 | 19 | | | |
| | 210 | | | 49 | *67 | 43 | 29 | | | |
| | 200 | | | 38 | 50 | *64 | 44 | 18 | | |
| | 190 | | | | 34 | 43 | *58 | 40 | 35 | |
| | 180 | | | | | 21 | 43 | *61 | 49 | |
| | 170 | | | | | | | 32 | *56 | 38 |
| | 160 | | | | | | | 21 | 38 | *44 |
| Comparative Example 9 | | | | | | | | | | |
| Hinoki | 240 | | *91 | 80 | 53 | 34 | | | | |
| | 230 | | 57 | *87 | 66 | 45 | | | | |
| | 220 | | | 45 | 71 | *76 | 59 | 38 | | |
| | 210 | | | | 41 | 64 | *83 | 39 | | |
| | 200 | | | | | 45 | 58 | *97 | 22 | |
| | 190 | | | | | | 50 | 62 | *76 | 45 |
| | 180 | | | | | | 37 | 48 | 79 | *85 |
| Comparative Example 10 | | | | | | | | | | |
| Japanese oak | 240 | | *89 | 62 | 39 | | | | | |
| | 230 | | 73 | *81 | 62 | 37 | | | | |
| | 220 | | 50 | 68 | *95 | 64 | | | | |
| | 210 | | | | 70 | *88 | 62 | | | |
| | 200 | | | | 53 | 79 | *92 | 66 | | |
| | 190 | | | | | 46 | *79 | 76 | 41 | |
| | 180 | | | | | | 65 | *86 | 73 | |
| | 170 | | | | | | 53 | 71 | *95 | 67 |
| | 160 | | | | | | | 47 | 62 | *79 |

Note) Values of the equation I at each temperatures for each periods of the high temperature high pressure steaming of each raw materials. The mark * shows the maximum value of the equation I at each temperature.

FIG. 1 shows plots of points for the optimum steam treatment for various raw materials to obtain the highest strength values of the equation I of the board. The conditions for the optimum steam treatment were plotted for various raw materials, obtained in the embodiments 10 and the comparative examples 8–10.

The curve of the optimum steam treatment recited in U.S. Pat. No. 5,017,319 is shown in FIG. 1. The equation recited in the U.S. Patent is: T (°C.)=306.4–35.7 $\log_{10}$ t (second) corresponds to the equation: T (°C.)=242.9–35.7$\log_{10}$ t (minute).

From FIG. 1, it can be understood that the optimum conditions for the steam treatment for the lignocellulosic materials such as the hinoki, the lauan and the Japanese oak used in the comparative examples are in line with the curve of U.S. Pat. No. 5,017,319. However, it is found that, when the kenaf is used as the raw material, the board can be obtained under far lower temperatures and shorter period of the steam treatment.

EMBODIMENT 11

150 g of the kenaf woody flakes and 300 g of water were supplied in a 3 liter high pressure vessel (A) equipped with a heater and the mixture was heated by setting the heater at 250° C. to treat at 135° C. for 20 minutes which are optimum conditions for the high temperature and high pressure steam treatment of the kenaf flakes.

20 minutes after the start of heating, the inner temperature of the vessel (A) reached 135° C. After the vessel temperature was held at 135° C. for 20 minutes, water was sprinkled on the vessel (A) to cool it to lower than 100° C. It took around 115 minutes for cooling down the vessel.

Thereafter, the board was prepared in the same manner as shown in the embodiment 2.

The density of the board was 0.76 g/cm$^3$, the bending strength was 408 kgf/cm$^2$, and the value of the Equation I was 339.

COMPARATIVE EXAMPLE 11

The Japanese oak was treated at 86° C. for 20 minutes which are the optimum condition for the high temperature and high pressure steam treatment in the same manner as in the embodiment 11 except that the Japanese oak was used in place of kenaf. The inner temperature of the vessel (A) reached 180°C. within 80 minutes after the start of heating.

The temperature was held at 180° C. for 20 minutes and then water was sprayed on the vessel A) to cool the vessel below 100° C. The period from the start of heating of the completion of cooling was 110 minutes.

The board was then prepared in the same manner as in the embodiment 2. The density of the board was 0.711 g/cm$^3$, the bending strength was 93 kgf/cm$^2$, and the value of the Equation I was 82.

COMPARATIVE EXAMPLE 12

The high temperature and high pressure steam treatment was carried out at 180° C. for 20 minutes in the same manner as in Example 11 except that the heater temperature for molding was set at 350° C. The period from the start of heating to the completion of cooling was reduced to 80 minutes. However, the sample near the contact part to the vessel was carbonized and stuck to the vessel. The board was then prepared in the same manner as in the embodiment 2.

The specific gravity of the board was 0.73 g/cm$^3$, the bending strength was 52 kgf/cm$^2$, and the value of the Equation I was 47.

It can be understood it is far easier to treat a *Malvaceous bast* plant with the high temperature and high pressure steam under an optimum condition than in the case of other lignocellulose substances and it can be produced easily in a normal batch-type pressure vessel.

EMBODIMENT 12

The kenaf board was prepared in the same manner as in the embodiment 2 except that the weight of the kenaf sample in the mat-forming process after moisture conditioned was changed from 100 g to 40 g.

The density of the board was 0.29 g/cm$^3$, the bending strength was 44 krf/cm$^2$ and the value of the equation I was 251.

EMBODIMENT 13

The woody part of the kenaf after removal of the bast from the stalk (rod-shaped in the diameter of 0.5 to 2.0 cm) was air dried and flaked (referred to as "the kenaf woody flake" hereinafter). The kenaf woody flakes was then mixed with air dried hinoki flakes in a ratio of 1:1 and the mixture was used as the raw material. The mixed flakes are moisture-conditioned and molding was performed by heating and pressurizing at 210° C. for 3 minutes to prepare a board containing merely a lignocellulosic material and its denatured product as the components.

The density of the board was 0.880 g/cm$^3$, the bending strength was 226 kgf/cm$^2$ and the value of the equation I was 140.

EMBODIMENT 14

The same raw material as the embodiment 13 was treated in the high temperature and high pressure steam at 180° C. for 3 minutes and then molded by heating and pressurizing at 210° C. for 3 minutes to prepare a board containing merely a lignocellulosic material and its denatured product as the components.

The density of the board was 0.845 g/cm$^3$, the bending strength was 314 kgf/cm$^2$, and the value of the equation I was 211.

EMBODIMENT 15

The woody part after removal of the bast from the stalk in the rod-shape in the diameter of 0.5 to 2.0 cm cut into about 30 cm length was air-dried, and treated in the high temperature and high pressure steam at the temperature of 180° C. for 3 minutes and then flaked to prepare the sample flakes (a). Then the sample (a) was mixed with the hinoki flakes in the ratio of 1:1. The mixed flakes are then moisture conditioned and molding was performed at 210° C. for 3 minutes to prepare the board containing merely a lignocellulosic material and its denatured product.

The density of the board was 0.86 g/cm$^3$, the bending strength was 195 kgf/cm$^2$, and the value of the Equation 2 was 127.

FIELDS OF APPLICATION

The product of the present invention is applied in the following industrial fields.

1) The board of the present invention has a far better mechanical strength than the boards based on self-adhesive activity of the conventional lignocellulosic material. Accordingly, the boards of the present invention are used as the particle board or the fiber board for furnitures, concrete panels, interior materials, floorings, and even core panels for automobile.

2) The board of the present invention contains no synthetic resin or contains a very small amount of synthetic resin as the component. Thus, it is a product which does not generate harmful substances and is useful for the maintenance of global environment.

3) The board of the present invention is expected to be biodegradable.

4) Since the boards of the present invention neither contains adhesive nor formaldehyde curing agent, the board does not generates gaseous formaldehyde and is safe.

5) The process for the preparation according to the present invention requires no adhesive material or uses only a small amount of adhesive material and the cost of the raw material can be reduced.

6) The mixing process of the lignocellulosic material and the adhesive can be eliminated when no adhesive is used, so that the manufacturing process can be reduced by eliminating mixing process, which simplify the manufacturing process compared to the conventional processes.

7) The board of the present invention can be manufactured without treatment by the high temperature and high pressure steam, so that the manufacturing processes can be reduced as compared to the conventional method.

8) When the steam treating is applied, the treatment can be completed at a vapor pressure of 10 to 12 kg/cm$^2$ within a short period of time, so that a particular facility is not necessary in the manufacturing process of the present invention. Therefore, it requires no particular equipment and can be completed with a conventional equipment for the pretreatment or fiber board.

9) The manufacturing method of the present invention utilizes the woody flakes which is substantially an industrial waste of a *Malvaceous bast* plant and thus the present method provides effective use of resources.

10) The manufacturing process of the present invention offers the light weight particle board, the density being less than 0.3 g/cm$^3$.

11) In the manufacturing process of the present invention, the high temperature and high pressure steam treatment can be carried out efficiently even in a usual batch-type pressure vessel.

What is claimed is:

1. A board prepared by compressing a lignocellulosic substance under heat and pressure, wherein at least 30 weight % of said lignocellulosic substance is a *Malvaceous bast* plant material, said board being free of an adhesive component, and said board exhibiting a value derived from the following Equation I of at least 100, $$\text{value}=0.48\times Y/X^2 \quad \text{(Equation I)}$$

wherein, Y is bending strength (kgf/cm$^2$), and X is density (g/cm$^3$).

2. A board according to claim 1, wherein the value of the Equation I is not less than 130.

3. A board according to claim 2, wherein said *Malvaceous bast* plant is kenaf.

4. A board according to claim 1, wherein said *Malvaceous bast* plant material is treated with steam for a period of less than 60 minutes, said steam having a temperature in the range of from about 105° C. to about 250° C. and a pressure corresponding to the saturated vapor pressure of said steam at said temperature.

5. A board according to claim 4, wherein said *Malvaceous bast* plant is kenaf.

6. A board according to claim 1, wherein a woody part of said *Malvaceous bast* plant is used.

7. A board according to claim 6, wherein said *Malvaceous bast* plant is kenaf.

8. A board according to claim 1, wherein said *Malvaceous bast* plant is kenaf.

9. A method for the preparation of a board comprising a lignocellulosic substance and being free of an adhesive component, said board exhibiting a value according to the following Equation I of at least 100, $$\text{value}=0.48\times Y/X^2 \quad \text{(Equation I)}$$

wherein, Y is bending strength (kgf/cm$^2$), and X is density (g/cm$^3$), said method comprising:

providing a lignocellulosic substance containing at least 30% by weight of a *Malvaceous bast* plant material and free of adhesives;

hot pressing said lignocellulosic substance at a temperature of between about 180° C. to 250° C., and at a pressure sufficient to press said lignocellulosic substance to a predetermined thickness.

10. A method according to claim 9, wherein a woody part of said *Malvaceous bast* plant is used.

11. A method according to claim 10, wherein said *Malvaceous bast* plant is kenaf.

12. A method according to claim 9, wherein said *Malvaceous bast* plant is kenaf.

13. A method according to claim 9, wherein said *Malvaceous bast* plant material is treated by steam for a treating period t, said steam having a temperature T in the range from about 105° C. to about 250° C. and a pressure corresponding to the saturated vapor pressure of said steam at said temperature T, wherein the relationship between said steam temperature T (°C.) and said treating period t (minutes) is governed by:

$$T=194-46\log_{10} t+/-40 \quad \text{(Equation II).}$$

14. A method for the preparation of a board having a value of the following Equation I of at least 150, $$\text{value}=0.48\times Y/X^2$$

wherein, Y is bending strength (kgf/cm$^3$) and X is density (g/cm$^3$), said method comprising the steps of:

providing a lignocellulosic substance containing at least 30% by weight of a *Malvaceous bast* plant material;

treating said plant material with steam having a temperature T in the range from about 110° C. to about 200° C. and pressure corresponding to saturated steam at said temperature T, said treating performed for a time period t less than 60 minutes, wherein said steam temperature T (°C.) and said time period t (minutes) of said treating corresponding to:

$$T=194-46\log_{10} t+/-20;$$

and hot pressing said lignocellulosic substance at a temperature in the range from about 200° C. to about 240° C. and at a pressure sufficient to press said lignocellulosic substance into a predetermined thickness.

15. A method according to claim 14, wherein said *Malvaceous bast* plant is kenaf.

16. A method for preparing a board having a value according to Equation I greater than 100:

$$\text{value}=0.48\times Y/X^2, \quad \text{(Equation I),}$$

wherein Y is bending strength (kgf/cm$^2$) and X is density (g/cm$^3$) , said method comprising:

providing an effective amount of a kenaf plant;

removing a bast portion from said kenaf plant;

flaking a woody portion of said kenaf plant after removal of said bast portion, thereby producing kenaf flakes;

treating said kenaf flakes by exposure to steam for a time period of from about 3 minutes to about 40 minutes, said steam having a temperature of from about 120° C. to about 180° C. and having a pressure generally corresponding to the saturated vapor pressure of said steam at said temperature;

ensuring that the moisture content of said kenaf flakes is from about 5% to about 15%;

providing a form adapted for pressing said kenaf flakes;

depositing said kenaf flakes in said form; and hot pressing said kenaf flakes in said form at a temperature of from about 210° C. to about 230° C. and a pressure of at least about 5 kg/cm$^2$.

* * * * *

UNITED STATES PATENT AND TRADEMARK OFFICE

CERTIFICATE OF CORRECTION

PATENT NO. : 5,728,269

DATED : March 17, 1998

INVENTOR(S) : Kohno et al.

It is certified that error appears in the above-identified patent and that said Letters Patent is hereby corrected as shown below:

On the title page,

In Section [75] Inventors, delete "Kaimatsus Co., Ltd." and insert --Kaihatsu Co., Ltd.--.

Column 1, line 58, delete "No. 5,017,319 79" and insert --No. 5,017,319--.

Column 4, line 53, delete "Furthermore, in" and insert --In--.

Column 7, line 28, delete "material" and insert --materials--.

Column 12, line 62, delete "86°" and insert --186°--.

Signed and Sealed this

Twenty-first Day of July, 1998

Bruce Lehman

*Attest:*

BRUCE LEHMAN

*Attesting Officer*

*Commissioner of Patents and Trademarks*